United States Patent [19]

Vieau

[11] 4,186,661

[45] Feb. 5, 1980

[54] FLEXOGRAPHIC INKING SYSTEM INCLUDING A REVERSE ANGLE DOCTOR BLADE

[75] Inventor: William J. Vieau, Green Bay, Wis.

[73] Assignee: FMC Corporation, San Jose, Calif.

[21] Appl. No.: 881,205

[22] Filed: Feb. 27, 1978

[51] Int. Cl.[2] ..... B41F 31/06; B41F 5/18

[52] U.S. Cl. ..... 101/178; 101/207; 101/350

[58] Field of Search ..... 101/350, 363, 364, 351, 101/352, 349, 207, 208, 209, 210, 148, 178; 118/258, 259, 262

[56] References Cited

U.S. PATENT DOCUMENTS

| | | | |
|---|---|---|---|
| 3,026,795 | 3/1962 | Dietrich | 101/148 |
| 3,041,967 | 7/1962 | Nystrand | 101/182 |
| 3,150,589 | 9/1964 | Senogles | 101/350 |
| 3,613,578 | 10/1971 | Heurich | 101/350 |
| 4,007,682 | 2/1977 | Gundlach | 101/350 X |

*Primary Examiner*—J. Reed Fisher

*Attorney, Agent, or Firm*—L. J. Pizzanelli; J. F. Verhoeven

[57] ABSTRACT

This disclosure concerns a modification to printing apparatus utilizing flexographic process inks. To insure an adequate supply of ink to the anilox roll, a barrier, preferably in the form of an idler roll, is provided to reduce the rate at which ink is recirculated back to the supply.

4 Claims, 5 Drawing Figures

FLEXOGRAPHIC INKING SYSTEM INCLUDING A REVERSE ANGLE DOCTOR BLADE

FIELD OF THE INVENTION

This invention relates to printing apparatus and more particularly flexographic process printing.

BACKGROUND OF THE INVENTION

Within recent years flexographic inks and plates have been developed to produce very accurate pictorial reproduction of a great variety of subject matter. For example, photographs depicting pastoral scenes and still lifes. In fact, process flexo printing compares favorably with the results achieved by rotogravure processes. Development of flexoprinting to its present state has been the result of a variety of evolutionary factors, not the least of which are the high degree of plate quality and flexographic process inks. While the inks must have physical properties to fulfill a variety of operating conditions, one of the most important properties is that of resoluability. Failing to meet this criteria causes build-up of inks in the cells of the anilox roll resulting in poor definition of the dot structures and, of course, the quality of the final product. Resoluability is also a significant factor in determining printing fidelity and speed.

Two approaches may be used in metering the ink on the anilox roll. One involves use of a doctor blade and the other involves a two-roll system which may consist of a fine line anilox roll and a hard rubber roll having a durometer on the shore A scale of 90. It is usual practice, preferred by many converters, to use a doctor blade oriented at a reverse angle since it produces better definition and constant density of color.

One of the problems arising with the use of processed inks is that of maintaining a pool of ink for distribution to the surface of the anilox roll regardless of speed and the physical properties of the ink. At certain web speed the gap between the anilox roll and the fountain roll did not maintain a substantially uniform pool of ink which resulted in storing certain cells of the anilox roll. By adjusting the spacing between the anilox roll and the fountain roll, the condition was improved but such an approach does not provide a viable operating environment solution. For example, and as will be explained in greater detail hereinafter, under certain operating conditions it has been found that a more narrow gap between the fountain roll and the anilox roll will produce good printing results at higher web speed.

SUMMARY OF THE INVENTION

According to the present invention, a flexographic printing station utilizing process inks is provided with means for insuring the creation and maintenance of a generally wedge-shaped pool for a supply of ink available for completely and consistently bathing the anilox roll under all operating conditions.

Further, in accordance with the present invention, the preferred arrangement for insuring the creation and maintenance of the pool of ink involves the provision of a roll which is freely rotatably mounted and rests upon and is driven by the fountain roll. This roll will be hereinafter sometimes referred to as a damming roll which in essence provides a barrier preventing the recirculation of ink back to the fountain. By providing a barrier it was found that the spacing between the anilox and the fountain roll can be kept constant regardless of web speed.

DESCRIPTION OF THE PREFERRED EMBODIMENT

Figure 1:
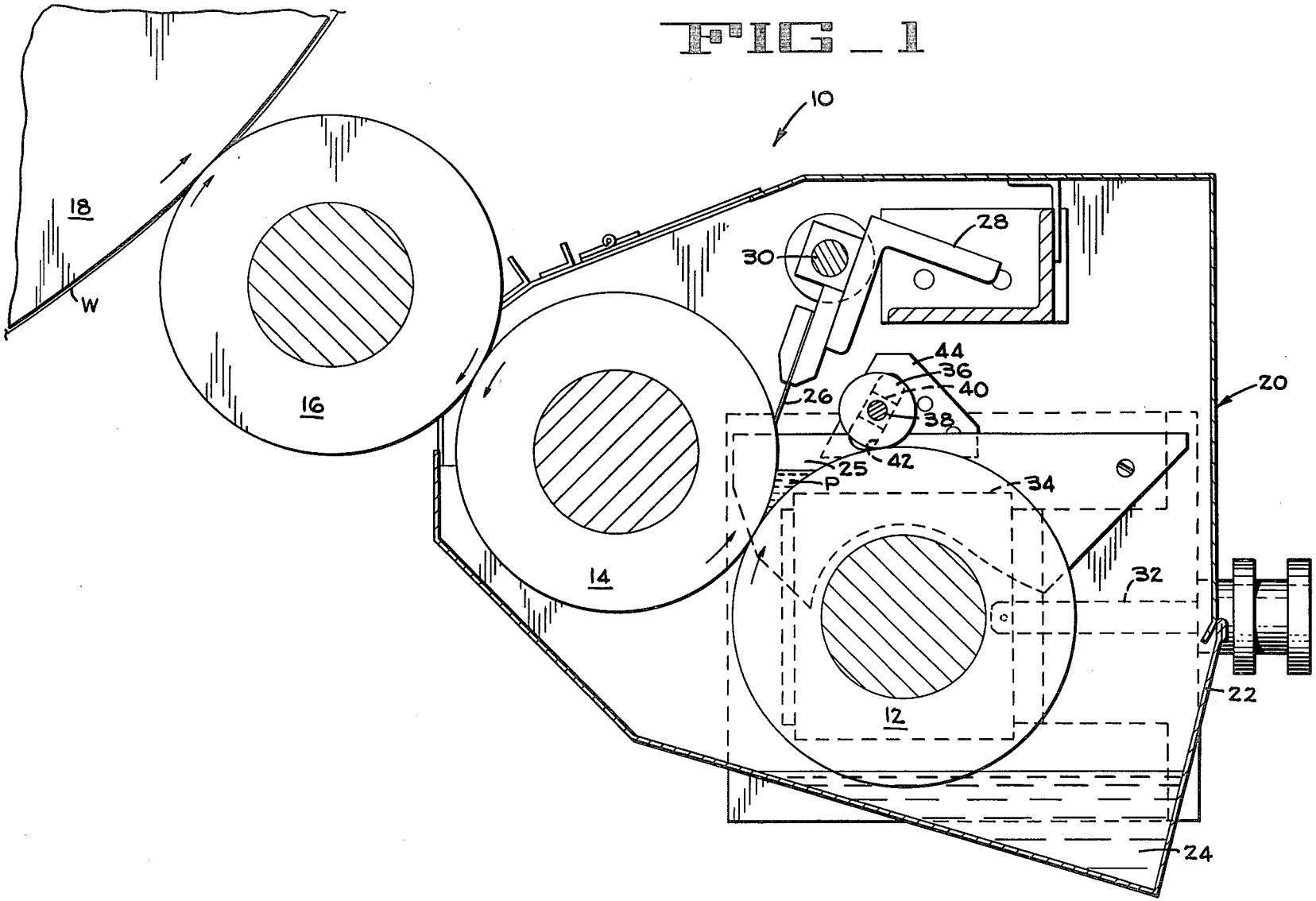
FIG. 1 is a side elevation with parts broken away of a printing station incorporating the concept of the present invention.
Figure 2:
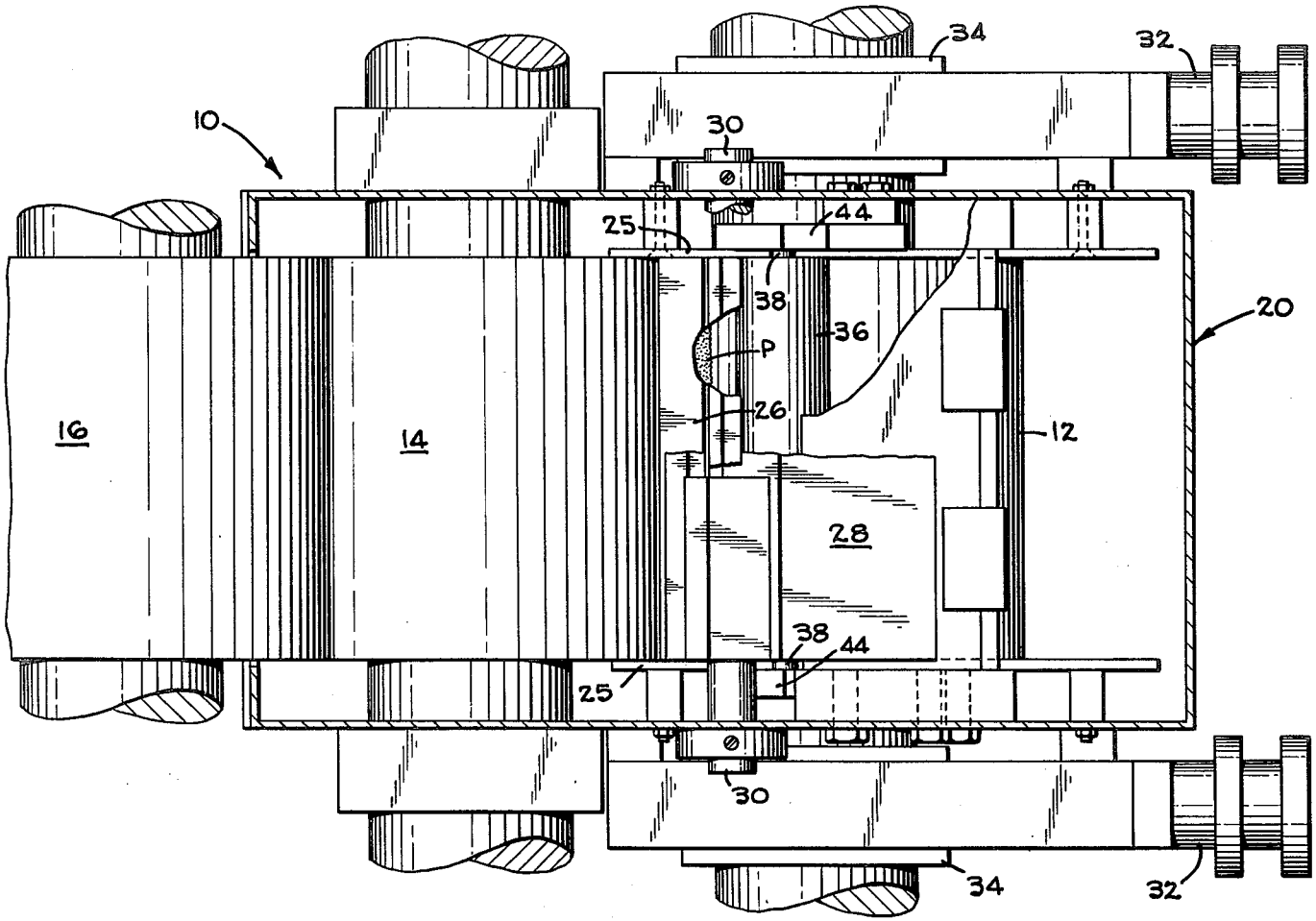
FIG. 2 is a fragmentary plan of FIG. 1, and FIGS. 3, 4 and 5 are enlarged fragmentary views of FIG. 1 illustrating the conditions obtaining when the spacing between the fountain roll and the anilox is changed.

The typical flexographic printing station shown in FIG. 1, and generally identified by the numeral 10, includes a series of cooperating rolls 12, 14 and 16 which are supported in a frame structure including gearing (not shown) which simultaneously rotates all the rolls in the directions indicated by the arrows. Since details of the supporting structure and the driving arrangement do not form part of the present invention they are not shown. In the art, the rolls 12, 14 and 16 are usually referred to respectively, as a fountain roll, an anilox roll and a plate cylinder.

A flexographic printing press may include several printing stations which are located in circumferentially spaced relationship to a large central drum 18 which constitutes a web-supporting platen for a web strip W. An example of the arrangement of a flexographic press incorporating six printing stations as shown and described in U.S. Pat. No. 3,501,108 to Roscoe et al, which was issued on Mar. 17, 1970. By reference thereto it is intended that this patent be incorporated herein.

Rolls 12 and 14 are located within a sheet metal housing 20 having a lower removable section 22 formed to define a well or reservoir 24 for containing a supply of ink which is continually replenished. The fountain roll or ink feeding roll 12 has a peripheral portion immersed in ink contained in the well 24 in order to feed the ink to the wedge-shaped intersection defined by roll 12 and the anilox roll 14 to produce a pool of ink P in this wedge-shaped area. By producing the pool, which is maintained as long as the rolls are rotating, a supply of ink is provided for the surface of the anilox roll, which, as mentioned above, supports the plate having the graphic pattern which is transferred to the web by the plate cylinder 16.

The wedge defining the pool of ink P extends for the entire width of rolls 12 and 14 to thereby constantly bathe the surface of anilox roll 14 with ink in order to fill the multitude of cells in the printing plate.

As is known in the art one of the requirements to achieve a high definition of printing requires the excess ink on the anilox roll to be removed leaving ink in the cells of the plate. For this purpose, a doctor blade 26, extending the entire width of roll 14 and secured to an angle member 28, is provided. The angle member 28 carrying the doctor blade is mounted for pivotal movement about pins 30 allowing the doctor blade to be pressed against the surface of the anilox roll 14 with the amount of pressure which will effect stripping of the ink and yet insure that excess wear is not imparted to the plate carried by the anilox roll 14.

Figure 3:
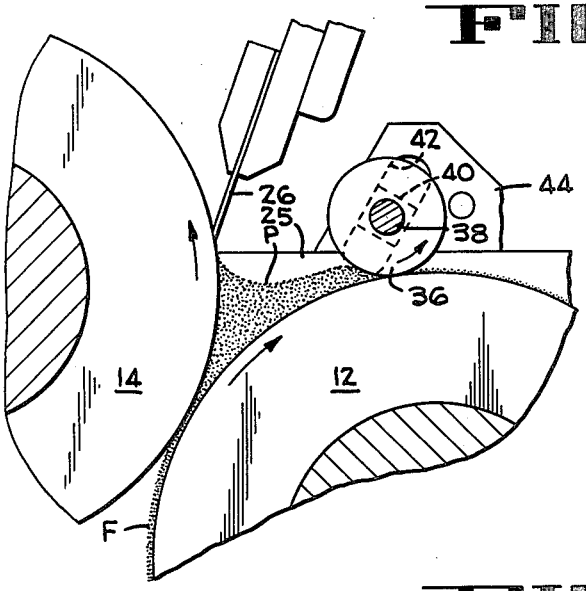
Figure 4:
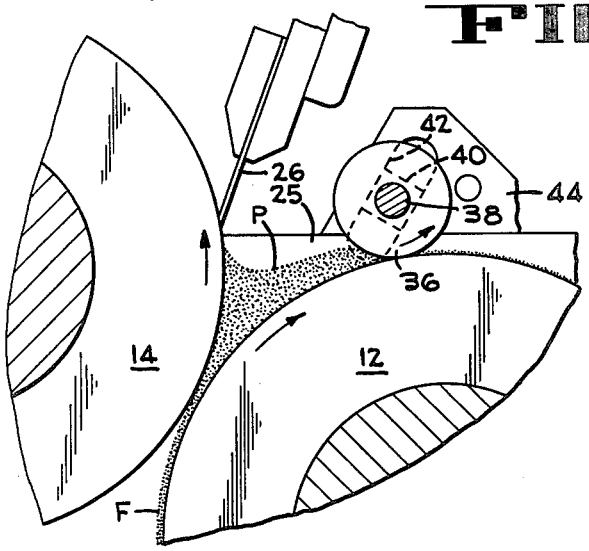
Figure 5:
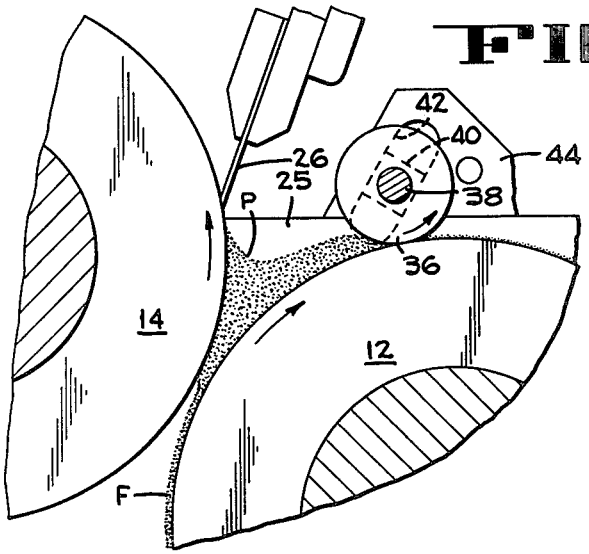

In order to transfer ink from the well 24 to the wedge shaped pool P, the fountain roll or ink feeding roll 12 is spaced from the anilox roll 14. FIGS. 3, 4 and 5 show the surfaces of the fountain roll 12 and the anilox roll 14 being spaced from each other and the film of ink which is transported by the fountain roll to create the ink pool P being also contained by side plates 25 pressed against the ends of rolls 12 and 14. Depending on a variety of factors, such as ink viscosity, the amount of ink demanded for the printing pattern being performed and the speed of the web W, the distance between the fountain roll and the anilox roll is adjusted to define a gap whose width is determined by the operator. To achieve such adjustment screws 32, connected to each bearing block 34 mounting bearings rotatably supporting each end of the fountain roll 12, are provided. As is evident, rotation of the screws associated with each bearing block can adjust the location of the fountain roll 12 with respect to the anilox roll 14 and thus establish a predetermined spacing between these rolls.

As mentioned above, it is essential that the pool P created between the anilox roll and the fountain roll contains a sufficient quantity of ink so that the entire surface of the anilox roll is constantly replenished with ink. At certain speeds it has been found that the ink pool would become discontinuous thereby starving certain portions of the plate carried by the anilox roll. Such a condition is unacceptable since the image transferred to the web would be lacking, in certain areas, of an impression having the correct density and tonal qualities. Correction of this condition by adjustment of the gap between the fountain roll and the anilox roll while effective if the gap was adjusted in accordance with web speed, is an unacceptable operating requirement.

Accordingly, the present invention provides means for retaining a sufficient quantity of ink in the pool P regardless of the operating speed of the web. While a variety of approaches can be taken to achieve this result, the present invention discloses a roller 36 formed with or integral with short axially extending stub shafts 38 which are rotatably mounted in generally rectangular blocks 40 that are slidably moveable in inclined guides 42 formed in brackets 44. The roller 36 rests on the fountain roll 12 producing a nip pressure which is sufficient to effect rotation of the roller 36 in the direction indicated by the arrow. The roller 36 thus effects a slight extruding or squeezing action on the film of ink to thus fulfill the function of a dam controlling the flow of ink from a pool back to the well 24.

In the absence of the roll 36 it was found necessary to adjust the gap between the fountain roll 12 and the anilox roll 14 to insure sufficient ink supply at various operating speeds. FIGS. 3, 4 and 5 show various gap adjustments between the fountain roll 12 and the anilox roll 14. The amounte of ink transferred from the well 24 by the fountain roll 12 is illustrated by the film F which, of course, is the source of ink for creating the ink pool P. Regardless of the gap spacing between the anilox and the fountain roll the film F will always be of constant thickness (all other factors being equal). Under actual operating conditions, with a gap of 0.022 of an inch at a web speed of 375 fpm, good results were achieved. On increasing the speed above 375 fpm, the ink film on the anilox roll became differentiated in thickness and discontinuities resulted. To correct this condition the gap between the anilox and the fountain roll was decreased to 0.008 of an inch. Good ink distribution on the anilox roll resulted but attempting to reduce film speed to 375 fpm at a gap of 0.008 of an inch again created some discontinuities in the tonal pattern transferred to the web.

The provision of the roll 36 achieves the result of maintaining a sufficient quantity of ink in the pool P as long as the gap between the fountain roll 12 and the anilox roll 14 is sufficient to allow unobstructed entry of the ink film F to the wedge-shaped area. Accordingly, establishing a relationship between web speed and the size of the gap is no longer necessary.

Although the best mode contemplated for carrying out the present invention has been herein shown and described, it will be apparent that modification and variation may be made without departing from what is regarded to be the subject matter of the invention as defined in the appended claims.

What I claim is:

1. A flexographic printing station for imparting a graphic pattern to a web supported by a platen roll, said station comprising a pan containing a supply of ink, a fountain roll, an anilox roll containing a graphic cell pattern forming a nip with said fountain roll, and a plate cylinder for transferring a pattern from the plate cylinder to the web; said pan being located below the centers of both said fountain roll and said anilox roll, said fountain roll being partially immersed in the ink supply, mean for mounting said fountain roll and said anilox roll for rotation in opposite directions so that the outer surfaces of said rolls at said nip move in the same upward direction, said surfaces being spaced apart to define a gap through which ink from the ink supply is fed by said fountain roll to a wedge-shaped cavity defined by the outer surfaces of said rolls above a line containing the centers of said rolls at said nip so that a pool of ink coating said anilox roll is produced, a doctor blade disposed at a reverse angle in contact with said anilox roll, and means adjacent said wedge-shaped cavity and in contact with said fountain roll for restricting the return of ink to said pan to thereby maintain a supply of ink in said wedge-shaped cavity.

2. The flexographic printing station according to claim 1 wherein said means for restricting the return of ink to the supply comprises a roll in rolling engagement with said fountain roll.

3. The flexographic printing station according to claim 2 wherein said roll in contact with said fountain roll is formed with short stub shafts at either end, bearings receiving said stub shafts, and slotted brackets slidably receiving blocks mounting said bearings.

4. A multicolor printing press including a large diameter web supporting platen roll having a plurality of printing stations adjacent to and circumferentially spaced about said platen roll; each of said stations comprising a pan containing a supply of ink, a fountain roll located above said pan and partially immersed in the ink, an anilox roll carrying a plate containing a graphic cell pattern forming a nip with said fountain roll, a plate cylinder in contact with said anilox roll and said web to effect transfer of a pattern to said web, said fountain roll and said anilox roll being spaced in close proximity to define a passageway to allow for transfer of ink from the supply to a generally wedge-shaped well formed by the outer surfaces of said fountain roll and said anilox roll above a line containing the centers of said rolls at said nip, means for mounting said fountain roll and said anilox roll for rotation in opposite directions so that the outer surfaces of said rolls at said nip move in the same upward direction and so that ink transferred from said supply of ink forms a pool of ink in said wedge-shaped well, and a reverse angle doctor blade in contact with said anilox roll, the improvement in said printing stations comprising a barrier in contact with said fountain roll and coextensive with and located at one extremity of said wedge-shaped well for limiting return of ink to said supply by said fountain roll.

* * * * *